US005529714A

United States Patent [19]

Tokosh

[11] Patent Number: 5,529,714

[45] **Date of Patent: * Jun. 25, 1996**

[54] TRANSPARENT SOAP FORMULATIONS AND METHODS OF MAKING SAME

[75] Inventor: Richard Tokosh, Saddle Brook, N.J.

[73] Assignee: Avon Products Inc., Suffern, N.Y.

[ * ] Notice: The portion of the term of this patent subsequent to Oct. 25, 2013, has been disclaimed.

[21] Appl. No.: 388,483

[22] Filed: Feb. 14, 1995

Related U.S. Application Data

[63] Continuation-in-part of Ser. No. 142,707, Oct. 25, 1993.

[51] Int. Cl.[6] ..... C11D 13/00; C11D 17/00

[52] U.S. Cl. ..... 252/108; 252/128; 252/129; 252/130; 252/131; 252/122; 252/367; 252/368; 252/370

[58] Field of Search ..... 252/108, 128, 252/129, 130, 131, 122, 367, 368, 370

[56] References Cited

U.S. PATENT DOCUMENTS

| | | | |
|---|---|---|---|
| 2,820,768 | 1/1958 | Fromont | 252/118 |
| 3,793,214 | 2/1974 | O'Neill et al. | 252/117 |
| 3,926,828 | 12/1975 | O'Neill et al. | 252/117 |
| 3,954,634 | 5/1976 | Monson et al. | 252/8.8 |
| 3,969,259 | 7/1976 | Lages | 252/107 |
| 4,165,293 | 8/1979 | Gordon | 252/118 |
| 4,468,338 | 8/1984 | Lindberg | 252/105 |
| 4,518,517 | 5/1985 | Eigen et al. | 252/107 |
| 4,704,223 | 11/1987 | Gupta et al. | 252/132 |
| 4,822,600 | 4/1989 | Wortzman | 424/59 |
| 4,839,080 | 6/1989 | Jungermann et al. | 252/107 |
| 4,851,147 | 7/1989 | Esposito et al. | 252/108 |
| 4,919,838 | 4/1990 | Tibbetts et al. | 252/117 |
| 4,963,284 | 10/1990 | Novakovic et al. | 252/108 |
| 4,980,078 | 12/1990 | Verite et al. | 252/118 |
| 4,988,453 | 1/1991 | Chambers et al. | 252/122 |
| 5,002,685 | 3/1991 | Chambers et al. | 252/134 |
| 5,041,234 | 8/1991 | Instone et al. | 252/118 |
| 5,296,218 | 3/1994 | Chen et al. | 424/70 |
| 5,310,495 | 3/1994 | Hill et al. | 252/118 |
| 5,417,876 | 5/1995 | Tokosh et al. | 252/130 |

*Primary Examiner*—Asok Pal
*Assistant Examiner*—Patricia L. Hailey
*Attorney, Agent, or Firm*—Hopgood, Calimafde, Kalil & Judlowe

[57] ABSTRACT

Formulations for transparent soaps and methods of preparation are disclosed. The transparent soaps are prepared by combining high and low molecular weight fatty acids in the presence of polyhydric alcohols. Citric acid is added to adjust pH. The formulations do not require volatile, short-chain monohydric alcohols to achieve transparency and the end products are able to retain transparent qualities when exposed to hot water conditions. Suitable formulations can be remelted to reduce waste.

3 Claims, No Drawings

TRANSPARENT SOAP FORMULATIONS AND METHODS OF MAKING SAME

RELATED APPLICATIONS

This is a continuation-in-part of U.S. patent application Ser. No. 08/142,707 filed Oct. 25, 1993.

FIELD OF THE INVENTION

The present invention relates to transparent soap formulations and corresponding methods of manufacture. More particularly, the invention is a transparent soap formulation prepared by combining high and low molecular weight fatty acids in the presence of polyhydric alcohols. Adjustments to pH are accomplished with citric acid.

BACKGROUND OF THE INVENTION

As used in this specification, the term "transparent soap" refers to a one-quarter inch soap section through which a person having 20/20 vision can read 14 point boldface type. This term is not restricted to those soaps which are clear or colorless because it is often desirable to add color to transparent soap. The present invention contemplates both colored and clear transparent soaps.

For commercial acceptance, transparent soaps must retain all the quality characteristics of conventional, opaque soap (such as good lather, hardness, mildness, minimum sluffing and the like). These products must remain transparent under normal use for extended periods of time. U.S. Pat. Nos. 3,793,214 and 3,926,828 describe known, but inferior, formulations made by neutralizing a mixture of saturated fatty acids and aliphatic monocarboxylic acid with a pH adjusting agent containing alkanolamines.

The present invention includes, inter alia, the production of transparent soaps comprised of sodium tallowate, sodium cocoate and non-volatile polyhydric alcohols, in which the pH is adjusted with citric acid. Transparent products made from the presently disclosed soap formulations have all of the desired qualities of conventional, opaque soap and additional features which permit economic and safe production.

Currently known soap formulations do not retain transparency when remelted, making it impractical to economically recycle excess waste. Conventional techniques also require aging, a process which evaporates volatile, short-chain monohydric alcohols. This aging process is time-consuming, expensive and potentially hazardous to production personnel.

The ability of soap to be remelted and retain all of its original qualities is critical for reducing costs. During production, a large reserve of scrap soap accumulates. This scrap is frequently discarded because it cannot be remelted to form a product which exhibits the original features. Lages U.S. Pat. No. 3,969,259; Verite U.S. Pat. No. 4,980,078 and Lindberg U.S. Pat. No. 4,468,338 disclose state-of-the-art transparent soap preparations which are subject to these deficiencies. These and other references demonstrate the need for a remeltable formulation to dramatically reduce production costs.

The traditional method for making transparent soap involves forming a solution of ingredients in a volatile solvent (commonly ethanol), casting the pourable mixture into large mold frames and allowing the volatile solvent to evaporate. Solidified soap is semi-opaque when initially cast. Solvent evaporation creates the transparent qualities of each formulation. But, evaporation is time-consuming and commonly causes a weight loss in excess of 15 percent.

For example, soap bars produced according to Chambers U.S. Pat. No. 4,988,453 must initially contain 6 to 15 percent volatile, low molecular weight alcohols (such as methylated spirits, ethanol and isopropanol) which require an aging period of several days to achieve transparency. In addition, the aging-evaporation procedure releases alcohol vapors which require expensive measures to reduce the hazards of exposure.

Other problems are known to the art. Typical casting methods cause shrink deformation resulting from the evaporation of alcohol and moisture. Transparent bars frequently have inferior end-use properties, despite higher retail prices when compared to opaque counterparts. Known transparent soaps frequently develop a sticky, opaque surface layer when placed in contact with water. And, high alkaline content can cause skin dryness. Soap bars which typically display these problems are produced according to the disclosures of Fromont U.S. Pat. No. 2,820,768; Poper U.S. Pat. No. 4,290,904 and Jungermann U.S. Pat. No. 4,758,370. They are sold commercially under the trade name "Neutrogena."

The present disclosure provides, inter alia, formulations which include sodium soap and polyhydric alcohols in critical weight percent ranges. These ingredients are mixed with specific acids to adjust the pH condition. Disclosed formulations produce soap products that do not require aging to obtain transparency, can be remelted and have the ability to accept color. This invention also provides a mild formulation which exhibits all the qualities of a conventional, high quality soap.

It is an object of the present invention to provide formulations and methods for making transparent soaps which do not require lengthy aging procedures or the use of hazardous, volatile, low molecular weight alcohols to achieve transparency.

Another object is to provide a transparent soap which can be remelted to achieve acceptable transparency using recycled production scrap.

A further object is to provide formulations for making transparent soaps which do not form undesirable opaque sluff-residues during or after end use application.

Yet another object is to provide transparent soap bars with exceptional gloss-like clarity and enhanced stability to light, heat and oxygen.

Still another object is to provide transparent soaps having excellent odor profiles with or without incorporation of a fragrance.

SUMMARY OF THE INVENTION

The present invention includes formulations and methods for making a transparent soap composition which contains polyethylene glycol, propylene glycol, glycerin, triethanolamine lauryl sulfate, alkoxylated cetyl alcohol, sodium hydroxide, sucrose, sodium cocoyl isethionate, unreacted free fatty acids, sodium tallowate, sodium cocoate and other minor ingredients such as fragrance, antioxidants, chelating agents, foam stabilizers, colorants and germicides.

Maintaining the correct balance of organic solvents and free fatty acids will produce an exceptional transparent product under the correct pH conditions. Organic solvents are preferably chosen from polyols having 2 to 6 carbon atoms. The term "polyol" generally defines a non-volatile, dihydric or higher, polyhydric alcohol such as polyethylene glycol, propylene glycol and glycerin.

The process for making the present transparent soaps essentially comprises the following steps.

1) Mixing a composite of polyethylene glycol, propylene glycol, glycerin, triethanolamine lauryl sulfate, alkoxylated cetyl alcohol and tetrasodium EDTA, while heating, until a temperature range between about 150° F. to 155° F. is attained.
2) Adding an aqueous sodium chloride solution and agitating while applying heat until the temperature range between about 150° F. to 155° F. is re-achieved.
3) Adding a blend of stearic acid, palmitic acid, myristic acid, oleic acid and lauric acid, and mixing the resulting batch while raising the temperature to a range between about 160° F. to 165° F.
4) Neutralizing the batch by slowly adding a 50% aqueous solution of sodium hydroxide over at least a 15 minute period while ensuring the temperature does not exceed about 195° F. After all sodium hydroxide has been added, the mixture is kept between about 175° F. to 195° F. for at least thirty minutes to ensure the reaction is complete and all solids are dissolved.
5) Adding sucrose to the batch and mixing until the sucrose is solubilized.
6) Slowly adding sodium cocoyl isethionate and vigorously agitating over at least a 15 minute period until all solids are dissolved, while maintaining a temperature range between about 175° F. to 190° F.
7) While maintaining agitation, cooling the batch to a temperature range between about 160° F. to 165° F., and adding to the cooled batch, pentasodium pentatate and tetrasodium etidronate.
8) Adjusting batch pH with citric acid to a range between pH 8.9 to 9.6 while maintaining agitation and a batch temperature range between about 160° F. to 165° F.
9) Cooling the pH adjusted batch to a temperature range between about 150° F. to 155° F. and slowly adding fragrance and color while gently agitating the cooled batch. The composite is then poured into molds and allowed to solidify.

As the description below further illustrates, the transparent soaps of the present formulation are made without lengthy processing and aging procedures. The method of the present invention does not require the use of volatile, low molecular weight alcohols to achieve transparency. Present formulations also provide a product that is compatible with hot water wash conditions without formation of the undesirable, opaque residues that develop with known transparent products.

The soap bar of this invention has exceptional gloss-like clarity, enhanced stability to light, heat and oxygen, as well as excellent odor characteristics with or without incorporation of a fragrance. Further, the unique formulation provides the delivery of other cosmetic materials and benefits, such as emolliency and deodorancy, while maintaining clarity and superior after-feel. These and other advantageous of the present invention are further described in this specification.

DETAILED DESCRIPTION OF THE INVENTION

The preferred formulations for the present transparent soaps contain the ingredients and ranges outlined in the following chart. All values are expressed in weight percents.

| INGREDIENT | MIN-IMUM W/W % | RANGE OPTIMUM W/W % | MAX-IMUM W/W % |
|---|---|---|---|
| Polyethylene Glycol | 0.1 | 9.60 | 15.0 |
| Propylene Glycol | 0.1 | 10.90 | 20.0 |
| Glycerin | 0.1 | 12.76 | 20.0 |
| Triethanolamine Lauryl Sulfate | 0.1 | 10.45 | 20.0 |
| Alkoxylated Cetyl Alcohol | 0.1 | 0.67 | 3.0 |
| Tetrasodium Edta | 0.1 | 0.14 | 0.5 |
| Tallow/Coconut Fatty Acid | 17.0 | 19.00 | 21.0 |
| Sodium Hydroxide (50%) | 6.0 | 7.60 | 9.0 |
| Sucrose | 3.0 | 7.84 | 12.0 |
| Sodium Cocoyl Isethionate | 1.0 | 3.80 | 10.0 |
| Sodium Chloride | 0.1 | 0.71 | 2.0 |
| Pentasodium Pentatate | 0.0 | 0.05 | 0.2 |
| Tetrasodium Etidronate | 0.0 | 0.05 | 0.2 |
| Citric Acid | 0.1 | 0.77 | 1.5 |
| Water | 5.0 | 11.04 | 15.0 |
| Fragrance | 0.0 | 1.0 | 3.0 |

A broad range of molecular weight fatty acids could be substituted to achieve similar results. For instance, soaps prepared from fatty acids having a distribution of coconut or other tropical nut oils may provide a lower end of the broad molecular weight spectrum (i.e., fatty acids with 6 to 14 carbon atoms); while soaps prepared from fatty acids having the molecular weight distribution of peanut oil, grapeseed oil or tallow may provide the upper end. In the preferred embodiment, the starting formulations have fatty acid components with 70 to 85% tallow and 15 to 30% coconut fatty acids.

The amount of fatty acid to be neutralized with a stoichiometric amount of a polyol or polyol blend is preferably in range ratio of about 1:1 to 1:3, and more preferably within the range of 1:1.9 to 1:2.5, with the optimum ratio being about 1:2.2. In addition to the neutralizing role, the presence of non-volatile polyols enhances the clarity of the end product and prevents shrinkage of the bar during storage and use. The sodium hydroxide in the indicated ranges provides further neutralizing activity for production of optimum transparency.

A correct pH range and the use of an adjusting agent are critical for achieving transparent soap bars from starting formulations. It has been unexpectedly discovered that adjusting the pH within a range of 9.1 to 9.5 will result in the desired end products. The optimum pH is approximately 9.2. Obtaining a pH outside the preferred range will opacify the product. Excess free alkalinity will also produce an opaque soap bar. A free fatty acid content in the range of 0.1 to 5.0% will provide transparent products. The preferred free fatty acid range is between 2.0 to 4.0%.

Water is an important ingredient because the hardness and clarity of the finished bar are strongly dependent on its total moisture content. There are several sources of water in this formulation such as the caustic soda solution and the water generated during the formation of sodium tallowate and sodium cocoate produced by the neutralization reaction. Water is also introduced with the addition of triethanolamine lauryl sulfate, alkoxylated cetyl alcohol and the like. The addition of free water to the bar formulation will also influence the final product. Generally, water addition of less than 5% total (not formed in situ or introduced by other ingredients) will usually result in a bar that is too hard and tends to form crystals with associated loss of clarity. Free water addition in excess of about 15% will usually result in a bar that is too soft.

Ingredients to improve mildness are also contemplated by the present formula. These ingredients may include sodium cocoyl isethionate and alkoxylated cetyl alcohol.

Foam boosters are also included in the formula to ensure sufficient lather characteristics. These compositions include triethanolamine lauryl sulfate and sodium cocoyl isethionate. But, the primary foam characteristics are provided by the reaction of fatty acid with sodium hydroxide.

A preferred formulation according to this invention comprises the following list of ingredients. All values are expressed in weight percents.

31.36% polyol component which is comprised of 10.88% glycerine, 10.88% propylene glycol and 9.60% polyethylene glycol 19.00% fatty acid component which is comprised of 5.32% stearic acid, 5.13% palmitic acid, 2.95% myristic acid, 2.84% oleic acid and 2.76% lauric acid 12.33% triethanolamine lauryl sulfate 7.84% sucrose 7.65% sodium hydroxide (50% aqueous solution)

3.80% sodium cocyl isethionate 0.77% citric acid 0.71% sodium chloride 0.66% alkoxylated cetyl alcohol 0.14% tetrasodium EDTA 0.05% pentasodium pentatate 0.05% tetrasodium etidronate q.s. water Additionally, the transparent soap bar can comprise about 98.00% of the above formulation plus about 1.75% of fragrance and about 0.25% of color tint.

EXAMPLE 1

TRANSPARENT SOAP BARS

Table 1, below, lists the ingredients and weight percents for a formula which was used to prepare test soap bars of the present invention. Additional examples demonstrate various properties of soap bars prepared according to this invention.

TABLE 1

| FORMULA | |
|---|---|
| INGREDIENTS | PERCENTAGE |
| Polyethylene Glycol | 9.6000 |
| Propylene Glycol | 10.8800 |
| Glycerin | 12.7618 |
| Triethanolamine Lauryl Sulfate | 10.4500 |
| Alkoxylated Cetyl Alcohol | 0.6650 |
| Tetrasodium Edta | 0.1425 |
| Tallow/coconut Fatty Acid | 19.0000 |
| sodium Hydroxide (50%) | 7.6000 |
| Sucrose | 7.8400 |
| Sodium Cocoyl Isethionate | 3.8000 |
| Sodium Chloride | 0.7125 |
| Pentasodium Pentatate | 0.0500 |
| Tetrasodium Etidronate | 0.0500 |
| Citric Acid | 0.7722 |
| Water | 12.0560 |

Polyethylene glycol, propylene glycol, glycerin, triethanolamine lauryl sulfate, akloxylated cetyl alcohol and tetrasodium EDTA were added to a tank equipped with a heating jacket and variable speed mixer. This composite was heated and mixed until a temperature of 150°–155° F. was attained.

A 85% tallow acid/15% coconut oil fatty acid blend was heated to approximately 150° F. and added to the mixed composite. The new composite was further mixed and heated until a temperature of 160°–165° F. was achieved.

A 50% aqueous solution of sodium hydroxide was slowly added to the mixture. Since the neutralization of the fatty acid is an exothermic reaction, sodium hydroxide addition must be controlled so the temperature will not exceed 195° F. After all of the sodium hydroxide was added, the composite was mixed for 15 minutes at approximately 195° F.

Water and the sodium chloride were mixed and heated in a side kettle. After the sodium chloride was totally solubilized, the water/sodium chloride solution was added to the mixing tank, followed by sucrose and sodium cocoyl isethionate. This composite was mixed vigorously, at approximately 170°–185° F. for 15 minutes, or until all of the ingredients were in solution.

After the ingredients were solubilized the temperature was reduced to approximately 160°–165° F. Pentasodium pentetate and tetrasodium etidronate were added after cooling. The composite was mixed for 10 minutes to achieve uniformity. At the same time, the temperature was lowered to 150°–155° F. and the mixer speed was reduced to minimize entrapped air bubbles.

The pH conditions were monitored during cooling. A 10% solution of citric acid was added until the pH was reduced to 9.1–9.5 and the free fatty content was between 2.0 and 4.0%. After the pH and free fatty acid were in an acceptable range, the composite was placed in molds to solidify.

EXAMPLE 2

MOISTURE CONTENT

This example demonstrates the importance of maintaining the correct moisture content. Transparent soap bars (Batch Nos. 141, 144, 151 and 152) were prepared in accordance with the formula and procedure of Example 1 (with different water content). Moisture content was measured and corresponding transparent qualities were noted for the various conditions. Objective criteria for acceptable transparency are described in the Background section. Results are indicated in Table 2.

TABLE 2

| BATCH NO. | % MOISTURE | TRANSPARENCY ACCEPTABLE | TRANSPARENCY UNACCEPTABLE |
|---|---|---|---|
| 141 | 20.05 | X | |
| | 19.65 | X | |
| | 19.29 | X | |
| | 18.59 | X | |
| | 18.37 | X | |
| | 17.47 | X | |
| | 17.14 | X | |
| | 16.60 | | X |
| | 15.91 | | X |
| 144 | 16.19 | | X |
| 151 | 13.23 | | X |
| 152 | 14.17 | | X |

In Batch 141 the soap base was maintained at 150°–155° F. in a holding tank and periodically sampled. Results showed that transparency was maintained as long as the moisture content was greater than 17%. Batches 144, 151 and 152 were also prepared with moisture values below 17%. In each instance, the transparency of the product was rated as "unacceptable."

EXAMPLE 3 pH AND FREE FATTY ACID CONTENT

Experiments were conducted to show the critical balance between pH and free fatty acid content in order to obtain an acceptable transparent product. Soaps were made according to Example 1 with modifications for pH values. Batches were identified as numbers 163, 165 and 166. Free fatty acid content and pH were measured as citric acid was added, then later correlated with objective observations for transparency in the relevant end products. Adding citric acid increased the free fatty acid content of the product while decreasing pH.

As shown by Table 3A, the transparency of end products was maintained as long as the pH did not fall below 9.1 and the free fatty acid content did not exceed 4.0%.

TABLE 3A

| BATCH NO. | pH | % FATTY ACID | TRANSPARENCY ACCEPTABLE | TRANSPARENCY UNACCEPTABLE |
|---|---|---|---|---|
| 163 | 9.44 | 2.01 | X | |
| | 9.31 | 2.87 | X | |
| | 9.19 | 3.62 | X | |
| | 9.02 | 5.83 | | X |

It was discovered that end products should have a free fatty acid content of about 2.0–4.0%. Soaps which had higher relative free alkalinity (about 0.055%) demonstrated unacceptable transparency. Measurement of free alkalinity in separate experiments confirmed these findings. The results are set forth in Table 3B.

TABLE 3B

| BATCH NO. | % FREE ALKALINITY | TRANSPARENCY |
|---|---|---|
| 165 | 0.055 | UNACCEPTABLE |
| 166 | 0.055 | UNACCEPTABLE |

EXAMPLE 4 REMELTABILITY

Tests were conducted to demonstrate the ability of the present formulations to be remelted and retain transparent qualities. Batch No. 150 was prepared according to the formula and procedure of Example 1 with modifications for moisture content. Because test conditions were designed to simulate high temperature recycling, the water content was raised above the ranges previously disclosed in this specification.

In the first set of experiments, the formulations were held at a high temperature for the time periods indicated in Table 4. At each time interval, moisture content and objective transparent qualities were noted.

TABLE 4

BATCH NO. 150

| TIME INTERVAL 150–160° F. | PERCENT WATER | TRANSPARENCY ACCEPTABLE | TRANSPARENCY UNACCEPTABLE |
|---|---|---|---|
| 0 Hour | 20.87 | X | |
| 1 Hour | 20.09 | X | |
| 2 Hours | 19.63 | X | |
| 3 Hours | 17.92 | X | |
| 4 Hours | 20.11* | X | |
| 5 Hours | 18.32 | X | |
| 6 Hours | 19.40* | X | |
| 7 Hours | 17.40 | X | |
| 8 Hours | 15.35 | | X |

*Water was added to keep moisture content in the desired range.

The Table 4 results demonstrate that the present formulations are able to maintain transparency even at extreme temperatures, as long as proper moisture content is maintained. For instance, at 4 and 6 hours, the addition of water maintained transparent qualities without sacrificing hardness.

The above product was discharged from the tank and allowed to solidify. After 24 hours, the solidified product (Batch No. 151, simulating scrap soap) was placed in a reaction tank and remelted at 150°–160° F. As shown by Table 4B, the correct moisture content was achieved by adding approximately 5% water. Remelted products had acceptable transparency resulting from the higher moisture content.

TABLE 4B

BATCH NO. 151

| TIME INTERVAL 150–160° F. | PERCENT WATER | TRANSPARENCY ACCEPTABLE | TRANSPARENCY UNACCEPTABLE |
|---|---|---|---|
| 0 Hour | 18.17 | X | |
| 1 Hour | 18.79 | X | |
| 2 Hours | 16.59 | X | |
| 3.5 Hours | 13.23 | | X |

It is to be noted that the definition for the term "transparent soap" (one-quarter inch soap section through which a person having 20/20 vision can read 14 point boldface type) as used in this specification is on a variable scale depending on the thickness and the amount of color tint added. For example, the boldface type may not be read as clearly if up to 2.0% by weight of formulation is color tint and the ultimate product is about one inch thick.

Various modifications and alterations to the present invention may be appreciated based on a review of this disclosure. These changes and additions are intended to be within the scope and spirit of this invention as defined by the following claims.

What I claim is:

1. A transparent soap formulation which comprises:

31.36% polyol component which is comprised of 10.88% glycerine, 10.88% propylene glycol and 9.60% polyethylene glycol;

19.00% fatty acid component which is comprised of 5.32% stearic acid, 5.13% palmitic acid, 2.95% myristic acid, 2.84% oleic acid and 2.76% lauric acid;

12.33% triethanolamine lauryl sulfate;

7.84% sucrose;

7.65% sodium hydroxide (50% aqueous solution);

3.80% sodium cocyl isethionate;

0.77% citric acid;

0.71% sodium chloride;

0.66% liquid alkoxylated cetyl alcohol;

0.14% tetrasodium EDTA;

0.05% pentasodium pentatate;

0.05% tetrasodium etidronate; and q.s. water.

2. A transparent soap bar which comprises:

about 98.00% of the formulation of claim 1;

about 1.75% of fragrance; and about 0.25% of color tint.

3. A method for manufacturing a transparent soap bar comprising the following steps:

mixing a composite of polyethylene glycol, propylene glycol, glycerin, triethanolamine lauryl sulfate, akloxylated cetyl alcohol and tetrasodium EDTA, while heating, until a temperature range between about 150° F. to 155° F. is attained;

adding an aqueous sodium chloride solution and agitating while applying heat until the temperature range between about 150° F. to 155° F. is re-achieved;

adding a blend of stearic acid, palmitic acid, myristic acid, oleic acid and lauric acid, and mixing the resulting batch while raising the temperature to a range between about 160° F. to 165° F.;

neutralizing the batch by slowly adding a 50% aqueous solution of sodium hydroxide over at least a 15 minute period while ensuring the temperature does not exceed about 195° F.;

maintaining the temperature between about 175° F. to 195° F. for at least thirty minutes and until all solids are dissolved;

adding sucrose to the batch and mixing until the sucrose is solubilized;

slowly adding sodium cocoyl isethionate and vigorously agitating over at least a 15 minute period until all solids are dissolved, while maintaining a temperature range between about 175° F. to 190° F.;

while maintaining agitation, cooling the batch to a temperature range between about 160° F. to 165° F., and adding to the cooled batch, pentasodium pentatate and tetrasodium etidronate;

adjusting batch pH with citric acid to a range between pH 8.9 to 9.6 while maintaining agitation and a batch temperature range between about 160° F. to 165° F.;

cooling the pH adjusted batch to a temperature range between about 150° F. to 155° F. and slowly adding fragrance and color while gently agitating the cooled batch; and pouring the resulting product into molds and allowing solidification.

* * * * *